US012385488B1

(12) United States Patent
Chiang et al.

(10) Patent No.: US 12,385,488 B1
(45) Date of Patent: Aug. 12, 2025

(54) ROTARY COMPRESSOR

(71) Applicant: RECHI PRECISION CO., LTD., Taoyuan (TW)

(72) Inventors: Li-Yao Chiang, Taoyuan (TW); Chia-Pin Chang, Taoyuan (TW); Wen-Jen Kuo, Taoyuan (TW); Hsi-Kun Hsu, Taoyuan (TW); Shun-Yung Huang, Taoyuan (TW)

(73) Assignee: RECHI PRECISION CO., LTD., Taoyuan (TW)

( * ) Notice: Subject to any disclaimer, the term of this patent is extended or adjusted under 35 U.S.C. 154(b) by 0 days.

(21) Appl. No.: 18/907,798

(22) Filed: Oct. 7, 2024

(30) Foreign Application Priority Data

Aug. 9, 2024 (TW) ..... 113130002

(51) Int. Cl.
*F04C 18/356* (2006.01)

(52) U.S. Cl.
CPC .... *F04C 18/3562* (2013.01); *F04C 2230/231* (2013.01); *F04C 2240/30* (2013.01); *F04C 2240/809* (2013.01)

(58) Field of Classification Search
CPC ..... F04C 18/3562; F04C 2230/231; F04C 2240/30; F04C 2240/809
See application file for complete search history.

(56) References Cited

U.S. PATENT DOCUMENTS 4,884,956 A * 12/1989 Fujitani ..... F04C 29/0035 418/150
5,427,511 A * 6/1995 Caillat ..... F01C 1/0215 464/112
5,580,230 A * 12/1996 Keifer ..... G01M 99/00 418/57
5,653,909 A * 8/1997 Muraki ..... C10M 169/04 62/468
6,695,201 B2 * 2/2004 Narasipura ..... F04C 23/008 228/199
7,581,936 B2 * 9/2009 Ogasawara ..... F04C 29/02 418/94

(Continued)

FOREIGN PATENT DOCUMENTS

JP 2003176797 A 6/2003
TW 591174 B 6/2004

(Continued)

*Primary Examiner* — Jesse S Bogue
(74) *Attorney, Agent, or Firm* — MUNCY, GEISSLER, OLDS & LOWE, P.C.

(57) ABSTRACT

A rotary compressor includes a housing, a motor and a compression pump. The housing includes a main shell, a top cover and a bottom cover. The motor is located in the housing. The compression pump is located in the housing and below the motor. The compression pump includes a cylinder. The cylinder includes a first end surface and a second end surface, an oil storage area is formed between the second end surface of the cylinder of the compression pump and a bottom cover of the housing. Wherein a volume of the refrigerant oil in the oil storage area is V, an inner diameter of the main shell is M, a distance between a bottom surface of the bottom cover and a bottom surface of the cylinder of the compression pump is H, a circumference is IT, and the following condition is satisfied: $25\% \leq V/(\pi(M/2)^2H) \leq 40\%$.

8 Claims, 6 Drawing Sheets

(56) References Cited

U.S. PATENT DOCUMENTS

| | | | | |
|---|---|---|---|---|
| 8,002,528 | B2 * | 8/2011 | Hodapp | F01C 21/007 417/410.5 |
| 8,585,385 | B2 * | 11/2013 | Watanabe | F04C 18/3562 418/179 |
| 9,181,940 | B2 * | 11/2015 | Cullen, Jr. | F04B 39/121 |
| 2006/0140791 | A1 * | 6/2006 | Deming | F04C 18/3564 417/410.3 |
| 2014/0219839 | A1 * | 8/2014 | Kuo | F04C 23/02 310/71 |

FOREIGN PATENT DOCUMENTS

| | | | |
|---|---|---|---|
| TW | 201817967 | A | 5/2018 |
| TW | 202126905 | A | 7/2021 |
| TW | M654680 | U | 4/2024 |

* cited by examiner

ROTARY COMPRESSOR

RELATED APPLICATIONS

This application claims priority to Taiwan Application Serial Number 113130002, filed Aug. 9, 2024, which is herein incorporated by reference.

BACKGROUND

Technical Field

The present disclosure relates to a compressor, especially relates to a rotary compressor.

Description of Related Art

The existing rotary compressor mainly includes the following components: exhaust pipe, casing, motor (stator, rotor), crankshaft, upper bearing, muffler, compression unit (cylinder, rings, vanes), lower bearing, bottom cover, outlet pipe, liquid reservoir and inlet pipe. The basic working principle of the compressor is as follows: when the compressor is energized, the stator generates a magnetic field, which rotates the rotor, drives the crankshaft, and causes the rings to move eccentrically in the cylinder, thus compressing the low-temperature and low-pressure gas into a high-temperature and high-pressure gas. The gas is then discharged from the cylinder through the muffler and into the shell, and then through a cut edge on the outside of the stator and the gap between the rotor, and then discharged into the refrigeration cycle system through the outlet pipe.

Hydrocarbon refrigerants are attracting a lot of attention in the industry as a result of concerns about energy conservation and carbon reduction. There is an important technical challenge when applying hydrocarbon refrigerant to refrigeration systems: the high flammability of hydrocarbon refrigerant requires that the refrigerant charge in the refrigeration system be strictly limited. As a result, the amount of refrigerant in the compressor housing must be significantly reduced, thereby reducing the refrigerant charge in the entire refrigeration system. In conventional compressors, in order to ensure the reliability of the compressor operation, it is necessary to fill the compressor with sufficient lubricating oil to ensure the height of the oil level inside the compressor. However, due to the high miscibility between hydrocarbon refrigerant and lubricating oil, the lubricating oil will contain a higher proportion of refrigerant, which may result in insufficient refrigerant charge during operation of the refrigeration system. Therefore, an effective way to solve this problem is to reduce the refrigerant charge inside the compressor by reducing the lubricating oil filling volume inside the compressor. This not only reduces the refrigerant charge of the entire refrigeration system, but also ensures the safety and operational efficiency of the system.

However, in order to ensure the reliability of operation, the existing rotary compressors need to be filled with lubricating oil to maintain the height of the oil level inside the compressor. Due to the good solubility between R290 refrigerant and lubricating oils, the more the compressor is filled with oil, the more R290 refrigerant will be dissolved in the refrigerant oil. This phenomenon will have an impact on the performance of the compressor and lead to a reduction in operation efficiency. This is still a problem that must be continuously overcome and solved by the developers of compressors and other related industries.

SUMMARY

This Summary is provided merely to summarize some example embodiments, so as to provide a basic understanding of some aspects of the subject matter described in the present disclosure. Accordingly, the features described in this Summary are merely examples and should not be construed to narrow the scope or spirit of the subject matter described herein in any way. Other features, aspects, and advantages of the subject matter described herein will become apparent from the following Detailed Description, Figures, and Claims.

According to one aspect of the present disclosure, a rotary compressor includes a housing, a motor and a compression pump. The housing includes a main shell, a top cover and a bottom cover. The motor is located in the housing. The compression pump is located in the housing and below the motor. The compression pump includes a cylinder, a ring, a vane, at least one spring, an upper support, a lower support and a crankshaft. The cylinder includes a compression chamber thereof. The compression chamber includes a vane groove, a spring hole and a suction hole, wherein the spring hole is communicated with the vane groove, the suction hole, the vane groove and the spring hole are independent of each other and are not communicated with each other. The ring is rotatably located in the compression chamber of the cylinder. The vane is reciprocally moved in the vane groove of the cylinder. A front end of the vane and a peripheral surface of the ring are in contact with each other. At least one spring is located at each of the spring holes of the vane, so that the front end of the vane is in contact with the peripheral surface of the ring. The upper support is located in the housing and above the cylinder. The lower support is located in the housing and below the cylinder. The crankshaft is located in the housing for disposing the upper support, the motor, the ring and the lower support. The bottom cover is surrounded by a tripod, the tripod and the bottom cover is a one-piece structure. The tripod includes a ring connection plate and a plurality of support parts. The support parts are arranged in a ring shape uniformly on an outside of the ring connection plate, and each of the support parts includes a support hole in a middle thereof. The cylinder includes a first end surface and a second end surface, an oil storage area is formed between the second end surface of the cylinder of the compression pump and the bottom cover of the housing for storing refrigerant oil. Wherein a volume of the refrigerant oil in the oil storage area is V, an inner diameter of the main shell is M, a distance between a bottom surface of the bottom cover and a bottom surface of the cylinder of the compression pump is H, a circumference is IT, and the following condition is satisfied: $25\% \leq V/(\pi(M/2)^2H) \leq 40\%$.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
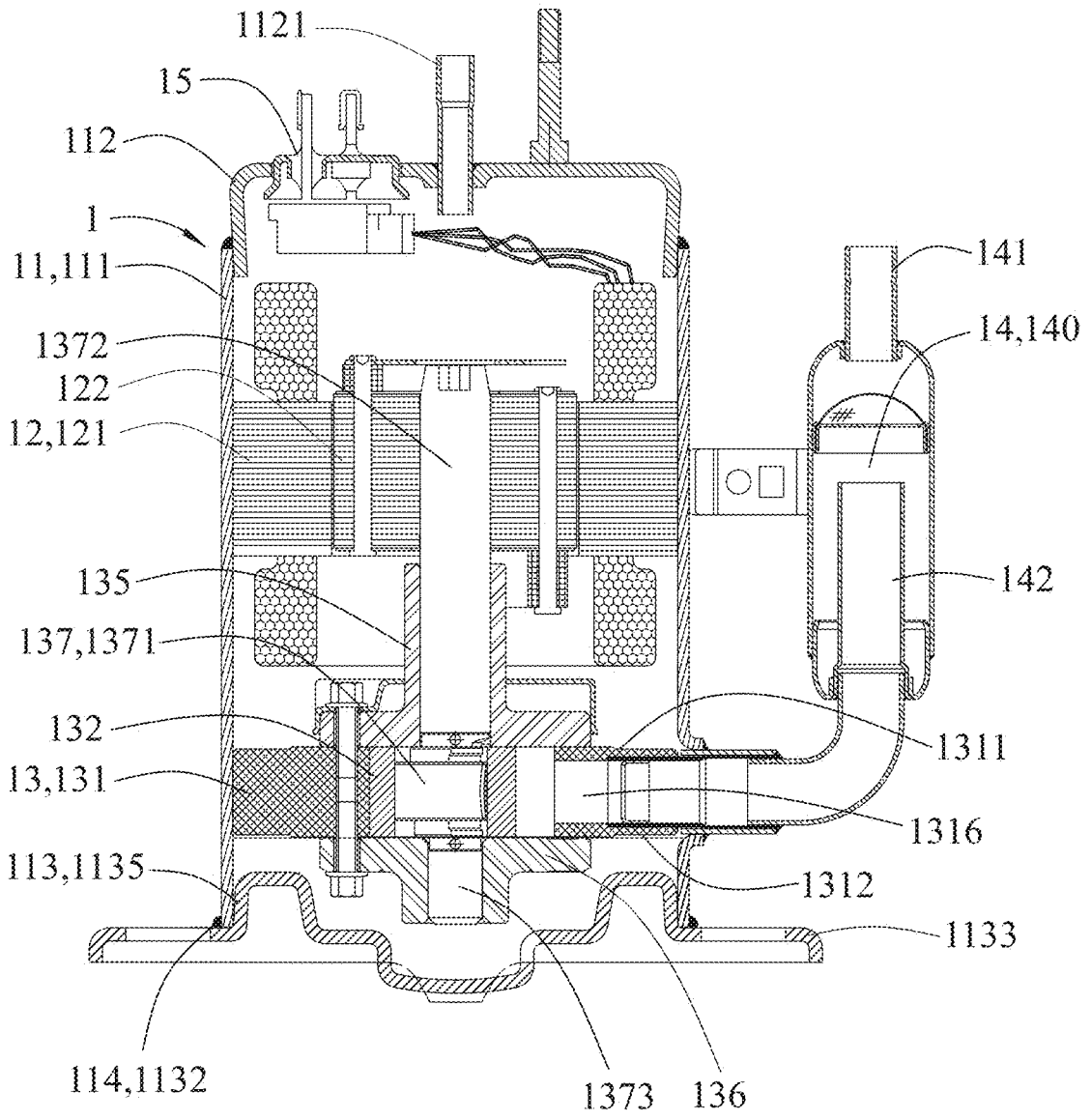
FIG. 1 is a cross-sectional view of the rotary compressor of the present disclosure.
Figure 2:
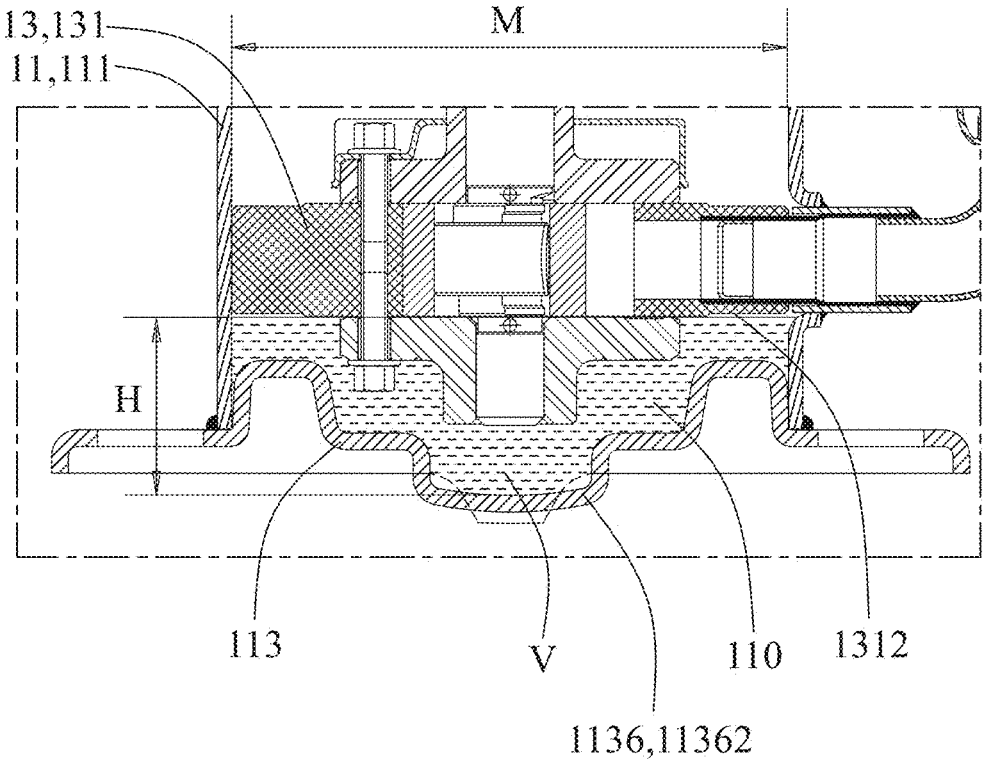
FIG. 2 is a partial sectional view of FIG. 1 of the present disclosure.
Figure 3:
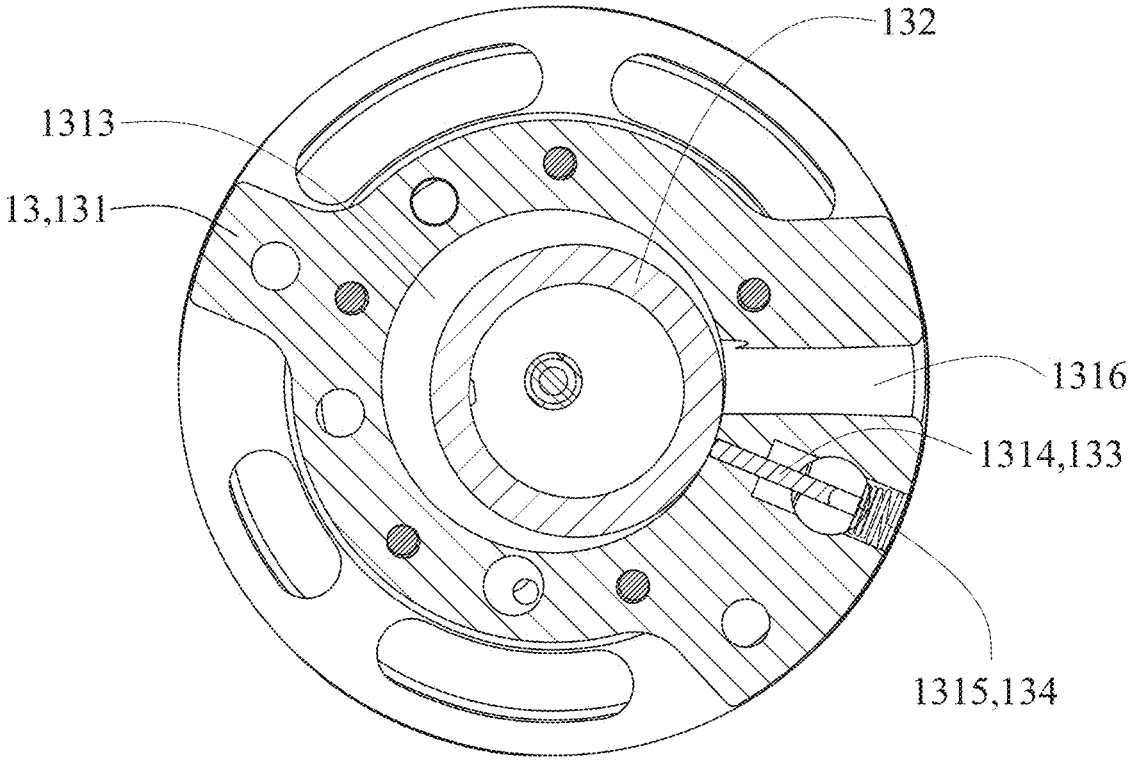
FIG. 3 is a cross-sectional view of the compression pump of the rotary compressor of the present disclosure.
Figure 4:
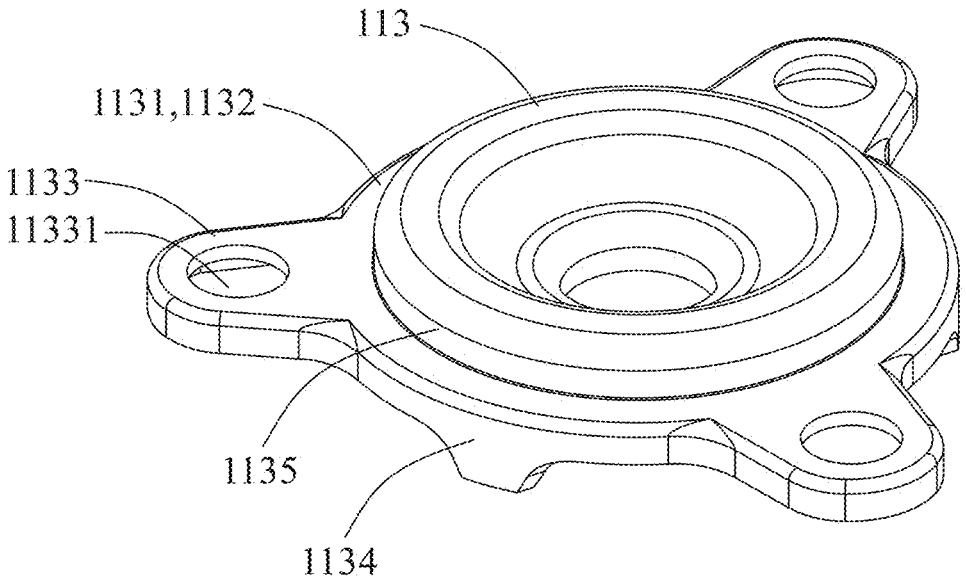
FIG. 4 is a three-dimensional drawing of the bottom cover of the rotary compressor of the present disclosure.
Figure 5:
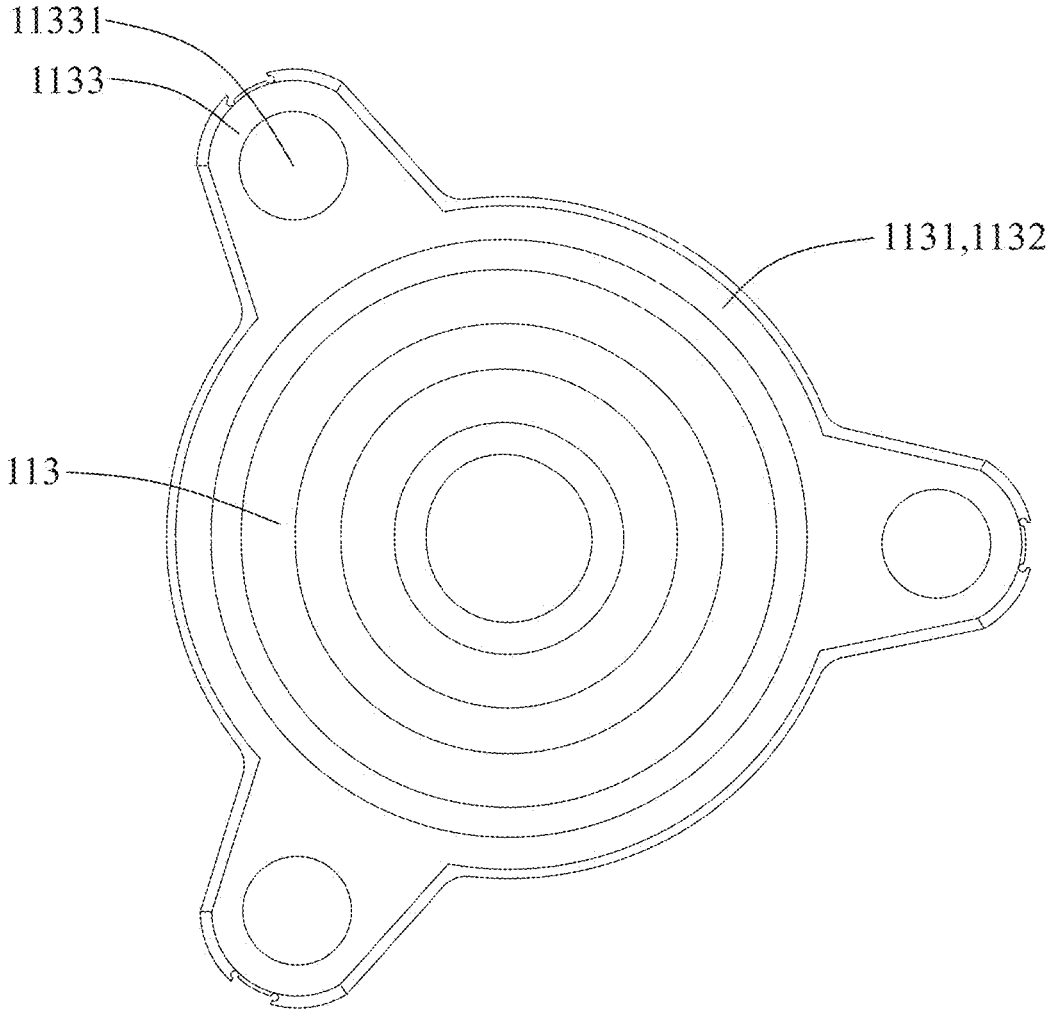
FIG. 5 is a top view of the bottom cover of the rotary compressor of the present disclosure.
Figure 6:
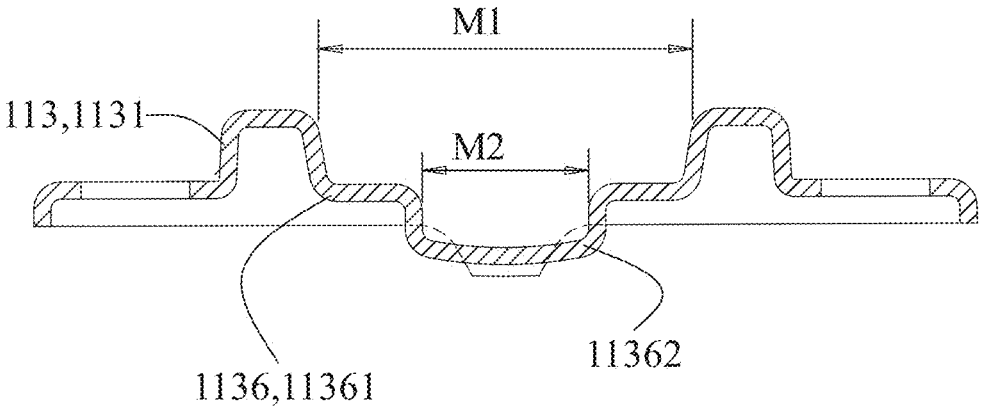
FIG. 6 shows a cross-section of the bottom cover of the rotary compressor of the present disclosure.

FIGS. 1 to 6 show a rotary compressor of the present disclosure. The rotary compressor 1 includes a housing 11, a motor 12 and a compression pump 13, and the rotary compressor 1 of the present disclosure is in the form of a vertical compressor.

The housing 11 is a hollow structure. The housing 11 includes a main shell 111, a top cover 112 and a bottom cover 113. The main shell 11 is used to accommodate the motor 12 and the compression pump 13 and other components. The housing 11 includes an outlet tube 1121, the outlet tube 1121 is disposed at either the top cover 112 or the main shell 111. In an example shown in the drawing, the outlet tube 1121 is disposed on the top cover 112. The housing 11 may be of various existing structural types available on the market, and there is no special restriction on the structural type thereof.

The bottom cover 113 is surrounded with a tripod 1131. The tripod 1131 and the bottom cover 113 are of one-piece structure. The tripod 1131 includes a ring connection plate 1132 and a plurality of support parts 1133. The support parts 1133 are arranged in a ring shape uniformly on the outer side of the ring connection plate 1132. Each of the support parts 1133 has a support hole 11331 in the middle thereof. The support holes 11331 are for assembling the foot pad, and the shape of the support parts 1133 are not limited. The number of the support parts 1133 is three or more, and the support parts 1133 are arranged at an equal interval. If the number of the support parts 1133 is three, the support parts 1133 are in a triangular arrangement, and the edge between two support parts 1133 includes a flanging 1134.

The bottom cover 113 includes a joint portion 1135 that corresponds to an inner wall of the main shell 111, and the joint portion 1135 is bent in the shape of upside-down U shape. The joint portion 1135 is integrated with the ring connection plate 1132, and when the joint portion 1135 of the bottom cover 113 is located within the bottom end of the main shell 111, the bottom end of the main shell 111 is connected to the ring connection plate 1132. The bottom cover 113 also includes a step portion 1136. The step portion 1136 is connected to the joint portion 1135 and is a hollow structure.

The rotary compressor further includes a plurality of fixing members 114. The fixing members 114 are disposed at a location where the ring connection plate 1132 and the bottom end of the main shell 111 are connected. The fixing member 114 is used for fixing the bottom cover 113 to the main shell 111, and further, the fixing member 114 is a spot-welded structure and is welded between the ring connection plate 1132 and the bottom end of the main shell 111.

The step portion 1136 of the bottom cover 113 includes a ring-shaped area 11361 and a recessed area 11362, the recessed area 11362 is located at the ring-shaped area 11361 and is extended downwardly. Furthermore, the recessed area 11362 is a ring-shaped structure and is located at a center of the ring-shaped area 11361. A radial end of the recessed area 11362 is connected to a radial outer end of the ring-shaped area 11361, and the recessed area 11362 is a downwardly-extended structure. An outer diameter of the ring-shaped area 11361 is M1, an inner diameter of the recessed area 11362 is M2, and the following condition is satisfied: $2 \leq M1/M2 \leq 3$. The ring-shaped 11361 and the recessed area 11362 can be made of one-piece.

The motor 12 is located within the housing 11 and includes a stator 121 and a rotor 122. The stator 121 is fixed on an inner wall of the main shell 111 of the housing 11, and the rotor 122 is rotatably located inside the stator 121. The motor 12 may be of various existing structural types available on the market and the structural type is not limited.

The compression pump 13 is located in the main shell 111 of the housing 11 and is located below the motor 12. The compression pump 13 includes a cylinder 131. The cylinder 131 is located in the main shell 111 of the housing 11, and is located below the motor 12. The cylinder 131 includes a first end surface 1311 and a second end surface 1312. The cylinder 131 includes a compression chamber 1313 located in a center thereof, the compression chamber 1313 runs through the upper and lower ends. A wall of the compression chamber 1313 includes a vane groove 1314, a spring hole 1315 and a suction hole 1316. The spring hole 1315 is not fully penetrated through the wall of the compression chamber 1313. The spring hole 1315 is communicated with the vane groove 1314, the suction hole 1316, the vane groove 1314 and the spring hole 1315 are independent of each other and are not communicated with each other. A ring 132 is rotatably located in the compression chamber 1313 of the cylinder 131. A vane 133 is reciprocally moved in the vane groove 1314 of the cylinder 131. A front end of the vane 133 and a peripheral surface of the ring 132 are in contact with each other, thus dividing the compression chamber 1313 into a suction region and a compression region. At least one spring 134 is disposed in the spring hole 1315. The spring 134 is located at a rear end of the vane 133, so that the front end of the vane 133 and the peripheral surface of the ring 132 are in contact with each other, and the rear end of the spring 134 is in contact with the inner wall of the main shell 111 of the housing 11. The spring 134 can be extended and retracted within the spring hole 1315, so that the front end of the vane 133 can be in contact with the ring 132 which is rotated eccentrically in the compression chamber 1313, and then produce a reciprocal motion. An upper support 135 is disposed within the housing 11 and is located above the cylinder 131. A lower support 136 is disposed within the housing 11 and is located below the cylinder 131. A crankshaft 137 has an appropriate length and is extended along a longitudinal direction. The crankshaft 137 is disposed in the housing 11, and the crankshaft 137 includes at least one eccentric portion 1371. The eccentric portion 1371 is located at an appropriate distance from the lower end of the crankshaft 137, so that the crankshaft 137 defines an upper shaft section 1372 and a lower shaft section 1373. The upper shaft section 1372 is for the upper support 135 and the rotor 122 of the motor 12 to fit, and the lower shaft section 1373 is for the lower support 136 to fit, and each eccentric portion 1371 is for the ring 132 of the cylinders 131 to fit. Therefore, the crankshaft 137 is for the upper support 135, the motor 13, the ring 132 and the lower support 136 to fit.

The compression pump 13 may be of various commercially available configurations and is not limited to such configurations. Furthermore, there is no limit to the number of the cylinder 131 and ring 132. The compression pump 13 can be a single-cylinder type, a double-cylinder type, a triple-cylinder or more than three cylinders can be used. The number of the cylinder 131 and the ring 132 can be correspondingly set to one, two, three or more than three. The number of the ring 132 is determined in accordance with the type of the cylinder 131, and the ring 132 is rotationally disposed in the compression chamber 1313 of the cylinder 131. In the figure, the compression pump 13 is a single-cylinder type.

Furthermore, an oil storage area 110 is formed between the second end surface 1312 of the cylinder 131 of the compression pump 13 and the bottom cover 113 of the housing 11, which is used for storing refrigerant oil. An oil volume of the refrigerant oil in the oil storage area 110 is V, an inner diameter of the main shell 111 is M, a distance between the bottom surface of the bottom cover 113 and the bottom surface of the cylinder 131 of the compression pump 13 is H, the bottom surface of the cylinder 131 is the second end surface 1312 of the cylinder 131, and a circumference is TT, and the following condition is satisfied: $25\% \leq V/(\pi(M/2)^2H) \leq 40\%$. Therefore, the overall filling volume of the oil and the refrigerant of the rotary compressor 1 can be reduced.

With the structure described above, it is further explained as follows:

In the embodiment, the rotary compressor 1 further includes a filter bottle 14. The filter bottle 14 is made of metal and has an appropriate length extended in a longitudinal direction. An inner space 140 is formed in the filter bottle 14. An inlet tube 141 is located at the top end of the filter bottle 14, and at least one inner tube 142 is disposed inside the filter bottle 14. The inner tube 142 extends to the outside of the filter bottle 14 and extends into the housing 11, and is connected to the suction hole 1316 of the cylinder 131 of the compression pump 13, so that the filter bottle 14 is located on one side of the housing 11. The low-pressure gas (refrigerant) inside the filter bottle 14 is transferred to the suction hole 1316 of the cylinder 131 of the compression pump 13 through the inner tube 142, and then transferred to the compression chamber 1313 to be continuously compressed to a certain pressure, and then output to the space located in the housing 11.

In more detail, the inner tube 142 of the filter bottle 14 and the cylinder 131 of the compression pump 13 are connected, and a refrigeration cycle system is connected between the inlet pipe 141 of the filter bottle 14 and the outlet pipe 1121 of the housing 11 of the rotary compressor 1. The number of the inner tubes 142 of the filter bottle 14 is not limited and can be determined by the type of the compression pump 13 (i.e., single-cylinder type, double-cylinder type, triple-cylinder type or more than three cylinder). The filter bottle 14 may be of various existing structural types on the market and is not limited to the structural type thereof.

In the embodiment, the rotary compressor 1 further includes an electrical connector assembly 15. The electrical connector assembly 15 can be disposed in the main shell 111 or the top cover 112. In the example of the figures, the electrical connector assembly 15 is disposed in the top cover 112 and is coupled to the motor 12. The electrical connector assembly 15 may be of various existing structural types on the market and is not limited to the structural type thereof.

According to the structure described above, when the rotor 122 of the motor 12 rotates, the crankshaft 137 is driven to rotate eccentrically, so that the eccentric portion 1371 of the crankshaft 137 can drive the ring 132 to rotate in the compression chamber 1313 of the cylinder 131, and the upper support 135 and the lower support 136 are supported by the upper shaft section 1372 and the lower shaft section 1373 of the crankshaft 137 and operate at high speed. And the compression pump 13 is in an operation status, so that the gas refrigerant is sucked into the compression chamber 1313 inside the cylinder 131 of the compression pump 13 and is continuously compressed to a certain pressure, and then the compressed refrigerant is discharged. However, in order to achieve a reduction in the amount of lubricating oil (refrigerant oil) and the refrigerant filled into the rotary compressor 1, a design of oil-reduction bottom cover is proposed for all series of rotary compressors 1, which is able to reduce the oil volume between the cylinder 131 and the bottom cover 113 by 55%, while maintaining the original performance (i.e., if the structure of the present disclosure is used, assuming that the refrigerant in the housing 11 is R290, and the original oil filling volume is 140 c.c., the filling volume can be reduced to 60 c.c.). It is defined that an oil storage area 10 is formed between the second end surface 1312 of the cylinder 131 of the compression pump 13 and the bottom cover 113 of the housing 11, and the oil storage area 10 is for the storing refrigerant oil, and the oil volume of the refrigerant oil in the oil storage area 10 is V, the inner diameter of the main shell 111 of the housing 11 is M, and the distance between the bottom surface of the bottom cover 113 and the bottom surface of the cylinder 131 of the compression pump 13 is H. In more detail, the bottom surface of the bottom cover 113 is the inner bottom surface of the recessed area 11362 of the step portion 1136 of the bottom cover 113, and the bottom surface of the cylinder 131 of the compression pump 13 is the second end surface 1312 of the cylinder 131 of the compression pump 13, which means that the distance H is the distance between the second end surface 1312 of the cylinder 131 of the compression pump 13 and the inner bottom surface of the recessed area 11362 of the bottom cover 113, and the circumference is IT, and the condition: $25\% \leq V/(\pi(M/2)^2H) \leq 40\%$ is satisfied. Under this condition, the space of the oil storage area 110 can be reduced, and the height level of the refrigerant oil still can be maintained, thereby reducing the refrigerant mixing into the refrigerant oil, the limited amount of refrigerant can produce the maximum capacity of the cold room, and the overall filling amount of the oil and refrigerant can be reduced, and the energy efficiency can be increased. There is no need to add additional additives (quality blocks, pads, etc.) in the bottom cover 113, and the problems of previous technologies can be effectively solved. In addition, the design is in line with the trend of hydrocarbon refrigerants and has the feature of simplifying the assembly process, which helps the refrigerant to work optimally in the system. It should be noted that the structure of the rotary compressor 1 of the present disclosure is not only applicable to the rotary compressor 1 using R290 refrigerant, but also applicable to the rotary compressor 1 using other environmentally friendly refrigerants.

The present disclosure provides a rotary compressor 1 capable of reducing the oil filling of the compressor, reducing the amount of refrigerant dissolved in the oil, thereby effectively reducing the refrigerant charge, improving the safety of operation of the combustible refrigerant compressor, and enhancing the efficiency of the rotary compressor 1.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rotary compressor comprising:

a housing comprising a main shell, a top cover and a bottom cover;

a motor located in the housing;

a compression pump located in the housing and below the motor, the compression pump comprising:

a cylinder comprising a compression chamber in a center thereof, the compression chamber comprising a vane groove, a spring hole and a suction hole, wherein the spring hole is communicated with the vane groove;

a ring rotatably located in the compression chamber of the cylinder;

a vane reciprocally moved in the vane groove of the cylinder, a front end of the vane and a peripheral surface of the ring are in contact with each other;

at least one spring located at the spring hole of the vane, so that the front end of the vane is in contact with the peripheral surface of the ring;

an upper support located in the housing and above the cylinder;

a lower support located in the housing and below the cylinder; and a crankshaft located in the housing and passed through the upper support, the motor, the ring and the lower support;

wherein the bottom cover is surrounded by a tripod, the tripod and the bottom cover is a one-piece structure, the tripod comprises a ring connection plate and a plurality of support parts, the support parts are arranged in a ring shape uniformly on an outside of the ring connection plate, each of the support parts comprises a support hole in a middle thereof;

wherein the cylinder comprises a first end surface and a second end surface, an oil storage area is formed between the second end surface of the cylinder of the compression pump and the bottom cover of the housing for storing refrigerant oil;

wherein an oil volume of the refrigerant oil is V, an inner diameter of the main shell is M, a distance between a bottom surface of the bottom cover and a bottom surface of the cylinder of the compression pump is H, and the following condition is satisfied:

$$25\% \leq V/(\pi(M/2)^2 H) \leq 40\%;$$

wherein the bottom cover comprises a step portion, the step portion comprises a ring-shaped area and a recessed area, wherein an outer diameter of the ring-shaped area is M1, an inner diameter of the recessed area is M2, and the following condition is satisfied:

$2 \leq M1/M2 \leq 3$, wherein the recessed area extends below the support parts.

2. The rotary compressor of claim 1, wherein the bottom cover comprises a joint portion, the joint portion is corresponded to an inner wall of the main shell and is bent in a shape of upside-down U shape, the joint portion is integrated with the ring connection plate, and when the joint portion of the bottom cover is located within the bottom end of the main shell, the bottom end of the main shell is connected to the ring connection plate, and the step portion is a hollow structure.

3. The rotary compressor of claim 1, wherein the tripod comprises at least three support parts, and each of the support parts is arranged at an equal interval.

4. The rotary compressor of claim 1, wherein an edge between two support parts comprises a flanging.

5. The rotary compressor of claim 2, further comprising a plurality of fixing members, wherein the fixing members are disposed at a location where the ring connection plate and a bottom end of the main shell are connected, and the fixing members are for fixing the bottom cover to the main shell.

6. The rotary compressor of claim 5, wherein each of the fixing members is a spot-welded structure and is welded between the ring connection plate and the bottom end of the main shell.

7. The rotary compressor of claim 2, wherein the recessed area is located at the ring-shaped area and is extended downwardly.

8. The rotary compressor of claim 7, wherein the recessed area is a ring-shaped structure and is located at a center of the ring-shaped area, a radial end of the recessed area is connected to a radial outer end of the ring-shaped area, and the recessed area is a downwardly-extended structure.

* * * * *